United States Patent [19]

Nijhawan et al.

[11] 4,247,370

[45] Jan. 27, 1981

[54] COKE OVEN FUMES CONTROL SYSTEM

[75] Inventors: Pramodh Nijhawan, Indianapolis; Joseph M. Duckworth, Zionsville, both of Ind.

[73] Assignee: Envirotech Corporation, Menlo Park, Calif.

[21] Appl. No.: 19,440

[22] Filed: Mar. 12, 1979

[51] Int. Cl.[3] ..... C10B 27/04

[52] U.S. Cl. ..... 202/263; 98/115 VM; 202/230

[58] Field of Search ..... 202/263, 262; 98/115 VM

[56] References Cited

U.S. PATENT DOCUMENTS

| | | | |
|---|---|---|---|
| 3,839,161 | 10/1974 | Pries | 202/263 |
| 4,069,108 | 1/1978 | Riecker | 202/263 |
| 4,123,333 | 10/1978 | Schulte et al. | 202/263 |

FOREIGN PATENT DOCUMENTS

| | | | |
|---|---|---|---|
| 2326630 | 12/1974 | Fed. Rep. of Germany | 202/263 |
| 2717005 | 10/1978 | Fed. Rep. of Germany | 202/263 |

*Primary Examiner*—Norman Yudkoff
*Attorney, Agent, or Firm*—Robert E. Krebs

[57] ABSTRACT

A coke oven fumes control system includes a duct-and-car arrangement extending alongside the coke oven quench car track. The car of the duct-and-car system supports a hood movable into overlying relation with a selected portion of the quench car. An additional hood overlies the coke guide. A system of connecting ducts connects the coke guide hood through the quench car hood to the car of the duct-and-car arrangement, thereby providing evacuation of both the quench car hood and the coke guide hood. The quench car hood is divided into a plurality of sectors. Butterfly valve dampers are provided for controlling evacuation of the various sectors of the quench car hood, as well as the coke guide hood.

12 Claims, 10 Drawing Figures

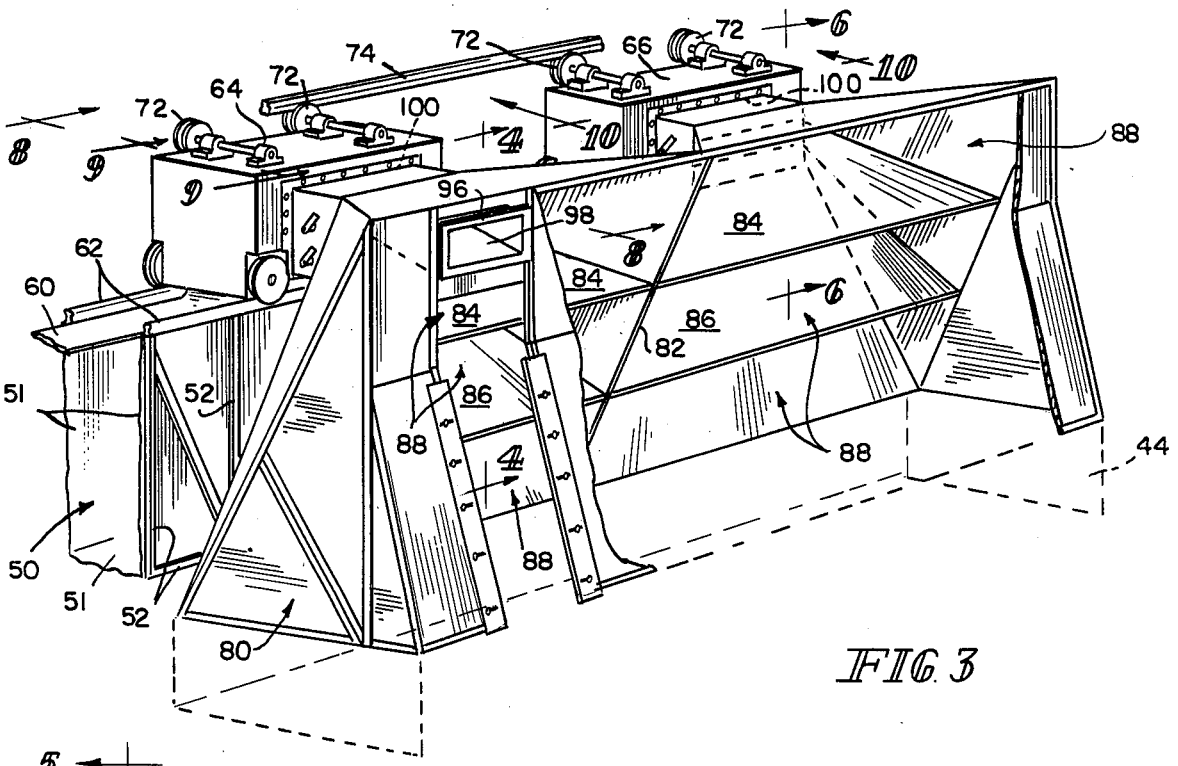
FIG. 3
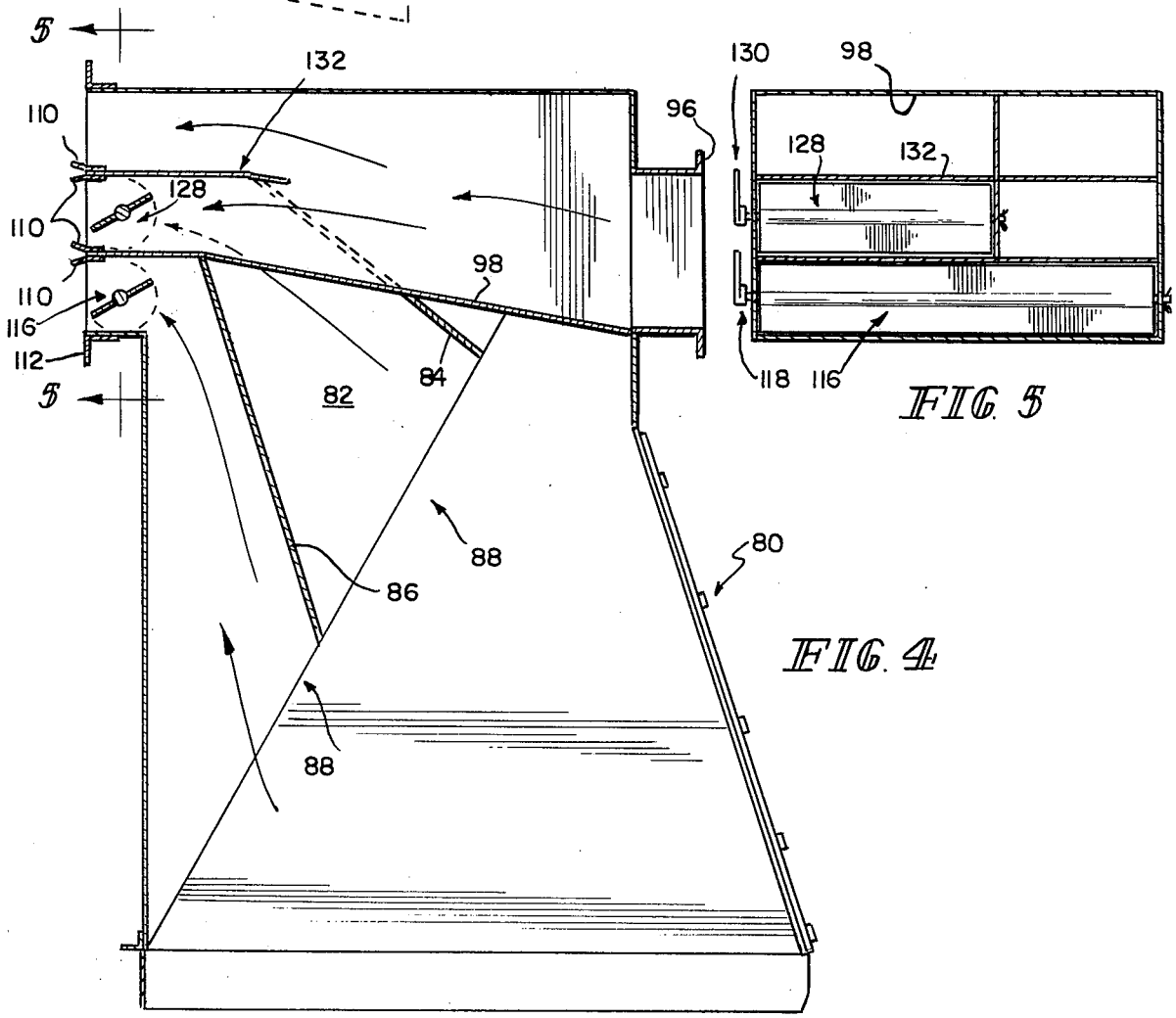
FIG. 5
FIG. 4

COKE OVEN FUMES CONTROL SYSTEM

This is a related application to the co-pending applications of the same inventors, assigned to the same assignee as the instant application, filed of even date herewith (i.e. Mar. 12, 1979), and having the following U.S. Ser. Nos.: 019,650; 019,651; 019,434 and 919,464.

This invention relates to pollution control, and primarily to a close-capture system for containing airborne contaminants such as those generated during a coke pushing operation in an oven of a coke oven battery.

Many industrial operations, such as coke pushing operations, generate large quantities of pollutant fumes and dusts. In a coke pushing operation, coke is pushed from a selected oven of a coke oven battery by a large ram through an oven door opening on one side (the so-called coke side) of the oven, through a coke guide and into a receptacle or conveyor, illustratively a so-called quench car or hot car. The hot, usually incandescent coke is transported in this receptacle or conveyor to a quench station, which may take the form of a quench tower or quench bath, in which the coke is drenched or submerged.

Several systems for capturing pollutants generated during transfer of the coke from the oven to the quench station are known. In some systems, such as those described in U.S. Pat. Nos. 3,630, 852 and 4,050,992, the entire coke side of the battery, or a substantial portion of it, is enclosed in a shed all the way down to the wharf upon which quenched coke is dumped. The entire shed is continuously or intermittently evacuated, illustratively through an overhead duct system which draws an enormous volume of pollutant-laden air from the interior of the shed. Of course, an equally enormous blower and large capacity filter system must be provided to accomodate the large volume of pollutant-laden air withdrawn from the shed interior.

The expense of such a system is evident. First, coke oven batteries typically are quite large. Thus, the shed itself must be quite large. Since there is no way of controlling the dispersal of pollutant dust and fumes within the interior of the shed, the ventilation system must be able to withdraw completely the entire volume of air within the shed over a predetermined, relatively brief span of time. Thus, in addition to the high cost of constructing the large shed on the coke side of the battery, a high-capacity ventilation system, typically including large inlet ducts, large blowers and high-capacity filter mechanisms (such as precipitators, scrubbers or bag houses) must be provided.

In other alternative systems, such as that illustrated in U.S. Pat. No. 4,029,551, a large hood carried by the coke guide-supporting car is connected through a flexible duct system of the general duct-and-car type illustrated in U.S. Pat. No. 4,069,108, for continuous or intermittent evacuation. Of course, in a system of that type, the coke guide-supporting car must travel to the quench station with the quench car to insure that airborne pollutants released between the push and entry of the quench car into the quench station are captured.

In a third type of system, illustrated in U.S. Pat. No. 3,675,400 a separate car, riding upon the same rails as the quench car, supports, in cantilever fashion, a hood designed to overlie the entire length of the quench car when the separate car is close to the quench car, and progressively less of the quench car as the separate car moves away from the quench car. Of course, the separate car must also be flexibly connected to a continuous or intermittent evacuation system. Placement of the ventilation system-supporting car on the same tracks as the quench car is extremely inconvenient, since it does not permit the ventilation system-supporting car to pass the quench car.

In another prior art system, the coke guide is surmounted by a hood. A quench car hood is separately mounted for movement along a pair of vertically spaced tracks supported above, and adjacent, the quench car tracks. The coke guide hood is supported for movement along the coke side of the battery from an overhead track lying vertically above the coke guide locomotive tracks. A continuously ventilated duct-and-car arrangement, of the general type described in U.S. Pat. No. 4,069,108, is disposed laterally along the coke side, with the coke guide locomotive tracks, the overhead coke guide hood supporting track, the quench car tracks, and the quench car hood-supporting tracks and framework located between the coke side of the battery and the duct-and-car arrangement. Separate ducts connect the coke guide hood and quench car hood to the car of the duct-and-car arrangement. The conduit connecting the quench car hood to the car of the duct-and-car arrangement includes a regenerative heat exchanger.

Typically, the quench car hoods of coke oven installations are fairly massive. Thus, it will be appreciated that, in order to support the quench car hood in such cantilever fashion, the wheels on the quench car hood, the vertically spaced tracks engaged by such wheels, and the framework supporting such tracks must be of fairly heavy and strong construction. Additionally, a separate framework, equally as sturdy as the one supporting the quench car hood, is provided to support the duct of the duct-and-car arrangement well above the level of the quench car tracks and out of interference with the unloading operation from the quench car onto the wharf. A system of this last-described type is offered jointly by Hartung, Kuhn & Co. Maschinenfabrik GmbH, Dusseldorf, and Firma Carl Still, Recklinghausen, both of West Germany.

Yet another type of system is illustrated by British Pat. specification No. 1,310,980. In systems of this type, a collapsible hood expanded and contracted by a fluid motor is provided around the coke guide to collect dusts and fumes generated during the push. A duct-and-car arrangement is used to evacuate the collapsible hood. In this embodiment, the car is inside the duct, and the duct is supported above the coke guide locomotive on a suitable support frame. An apparent weakness of the systems of this type is that no separate hood mechanism is provided for close capture of contaminants released from hot coke in the quench car after the push. Therefore, to insure capture of such contaminants, the coke guide locomotive must always accompany the quench car. Further, the coke guide hood must be sufficiently long to cover the entire length of the quench car. In very many situations, such requirements for adequate ventilation make installations of this type prohibitively expensive.

It is an object of the present invention to provide a simplified installation for close capture of dusts and fumes generated during a pushing operation in a coke oven.

According to the invention, a contaminant close-capture system is provided for a coke oven pushing operation. The system includes a suction source, a first duct extending along the coke side of a coke oven battery and coupled to the suction source for continuous evacuation. The first duct has a wall portion closed by a flexible web or belt, and a car disposed for movement along the first duct to raise the web or belt coupling the interior of the car to the interior of the duct. The system further includes mobile first hood means, means for coupling the first hood means to the car and for moving the car to dispose the first hood means in overlying relation to a selected portion of a conveyor, such as a quench car or hot car, to draw off contaminants evolved as hot coke is transported on the conveyor to the quenching station. The system further includes mobile second hood means mounted on a coke guide to draw off contaminants evolved as hot coke is pushed from the selected oven through the guide to the conveyor, and a second duct for connecting the second hood means to the first hood means, and thus to the first duct.

In the illustrated embodiment, valve means, such as dampers, are provided for selectively controlling evacuation of the second hood means. In the illustrated embodiment, the valve means is mounted in a third duct provided in the first hood means.

In the illustrated embodiment, proportioning guides are provided in the car, and are provided with selectively actuable dampers. These independent dampers permit valving of suction selectively either only through the second hood means, or through both the second hood means and first hood means.

Further, the first hood means, the quench car hood, is divided into a plurality of sectors, in accordance with the illustrated embodiment. Division of the quench car hood into sectors and independent valving or damping of each sector, or group of sectors, permits establishment of suction selectively in various areas of the quench car hood. In many instances this is highly desirable, since at times the quench car hood may overlie only a portion of the quench car, or only a portion of the quench car may contain outgassing coke over which suction must be established.

Further according to the invention, a system of multiple cars is provided on the first duct, illustratively one car for each twenty feet of length of the first hood means. A primary advantage of a multiple car system is that the weight of the first hood means can be supported cooperatively, and the load of the first hood means distributed over several cars.

The invention may be best understood by referring to the following description and accompanying drawings which illustrate the invention. In the drawings:

FIG. 3 is a fragmentary perspective view of a detail of the installation of FIGS. 1-2;

FIG. 4 is a fragmentary sectional view of the installation of FIGS. 1-3 taken generally along section lines 4—4 of FIG. 3;

FIG. 5 is a fragmentary sectional view of a detail of the installation, taken generally along section lines 5—5 of FIG. 4;

Figure 1:
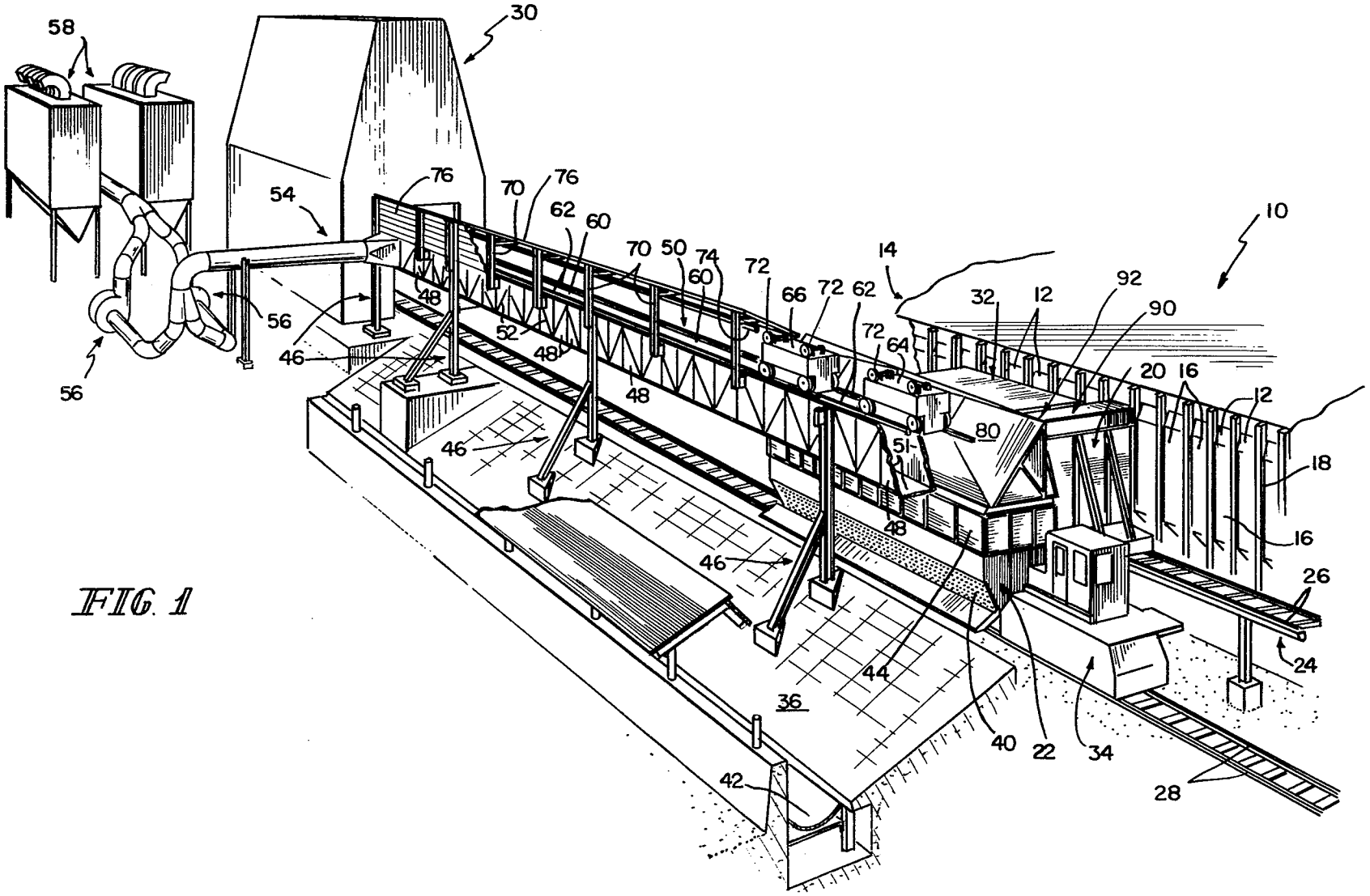
FIG. 1 is a partly fragmentary perspective view of a typical coke oven battery installation, with the close-capture contaminant control system of the instant invention installed.
Figure 2:
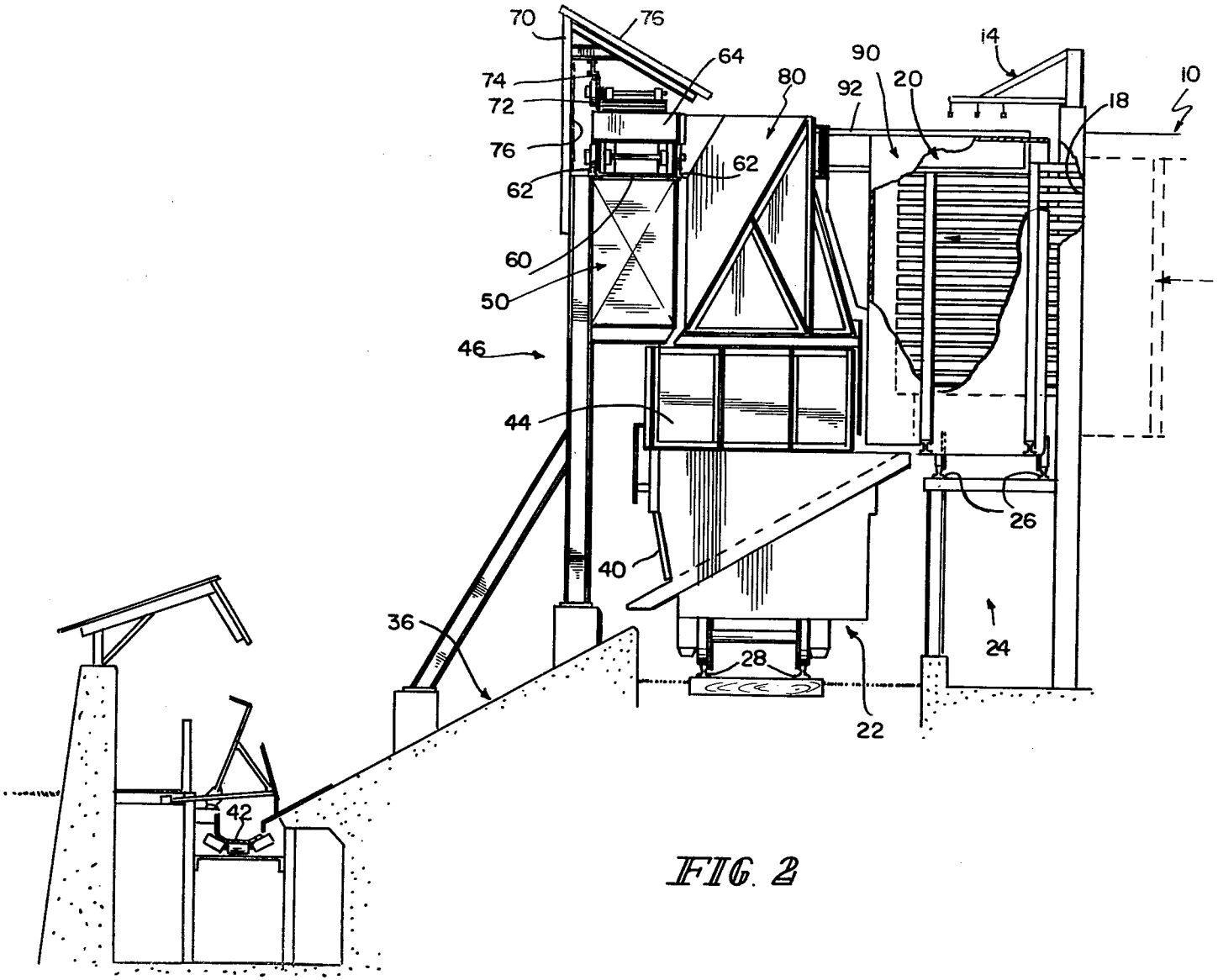
FIG. 2 is a partly fragmentary end elevational view of the installation of FIG. 1.

Referring now particularly to FIGS. 1-2, a coke oven battery 10 consists of several coke ovens 12 in parallel. Each oven 12 is provided at its coke side end 14 with a door 16, and at its push side end (not shown) with a ram for pushing coke through the oven from the ram side to the coke side 14 to empty the oven. The oven 12 is emptied through its door opening 18 and a coke guide 20 into a waiting quench car 22. The coke guide 20 is movable along a master gallery 24 on railroad-type rails 26 to align it with a selected oven 12 to be emptied. Similarly, the quench car 22 is movable along the coke side 14 of the oven battery 10 to receive the coke pushed through the guide 20. The quench car 22 is movable on railroad-type rails 28 which extend along the coke side and to a quenching station 30, illustratively, a quenching tower. The means for moving the coke guide 20 to a selected oven 12 is a door machine locomotive 32 movable on rails 26. This machine 32 incorporates the function of supporting and moving the coke guide with the function of removing the door 16 from the selected oven 12 and replacing the door after a push is completed. The quench car 22 is moved by a locomotive 34 mounted on the rails 28.

An unloading wharf 36 is provided adjacent the rails 28 to permit quenched coke from station 30 to be unloaded through a door 40 on quench car 22 and gravity-fed to a continuous coke conveyor belt 42. Coke conveyor belt 42 transfers the finished coke to a storage area. The door 40 is perforated to permit the water used to quench the coke in car 22 to drain from the car 22.

Quench car 22 also includes extended side walls 44 which increase the vertical height of the quench car 22 up to the vertical height of the top of the locomotive 34.

The ventilation, or pollution evacuation, system for the pushing operation includes a longitudinally spaced series of support posts or pillars 46 anchored in the wharf 36 adjacent rails 28. Each pillar 46 supports a longitudinally extending section 48 of a first duct 50. Each section 48 includes its own supporting framework 52 which cooperates with a respective pillar 46 to make each section 48 generally self-supporting. Each section 48 is coupled in sliding, substantially air-tight sealing engagement with its adjacent duct sections 48. This sectional arrangement permits relatively unimpaired thermal variations in the length of each section 48 without adversely affecting the total length of the duct 50. Transition and connector duct sections 54 at one end of the first duct 50 couple the interior of duct 50 through suction means 56 to an assembly, such as a bag house, fume scrubber or separator 58. Dust and fumes from the hot coke are separated at station 58 and clear air is exhausted to atmosphere.

The duct 50 is generally rectangular in transverse section, and includes three rigid walls 51 supported in the framework 52, and an upper wall section which is closed by a flexible web or belt 60. The vertically upper edges of the vertically extending wall of duct 50 are provided with rails or tracks 62 supporting substantially identical, belt-lifting first and second cars 64, 66 for movement along duct 50. The operation of the cars 64, 66 on duct 50 is generally as described in U.S. Pat. Nos. 2,923,227, 3,478,668, 3,481,265, 3,698,137, 3,705,545, 3,788,208, and 4,086,847, as well as the above-identified British Pat. No. 1,310,980, and U.S. Pat. Nos. 4,029,551, 4,069,108.

Vertically extending supports 70 are attached to the framework 52 so as to avoid interference with movement of the cars 64, 66 along tracks 62. Each car 64, 66 includes a pair of upper wheels 72. Supports 70 support a track 74 which is engaged by wheels 72 of each car. Supports 70 also support a pent roof 76 which protects wheels 72, tracks 74 and the web or belt 60 from weather.

The contaminant capture system includes a first, mobile hood 80. Hood 80 is divided, as illustrated in FIG. 3, by a central, vertical partition 82. Hood 80 is further divided by two partitions 84, 86, which extend along the length of the hood, into six sectors 88.

The coke guide 20 is surmounted, and substantially enclosed, by a second mobile hood 90. Hood 90 is coupled to a second duct 92 which terminates at a flange 94 adjacent hood 80. Hood 80 is provided with a mating flange 96 (FIGS. 3–4). A third duct 98 is provided internally of hood 80.

Figure 8:
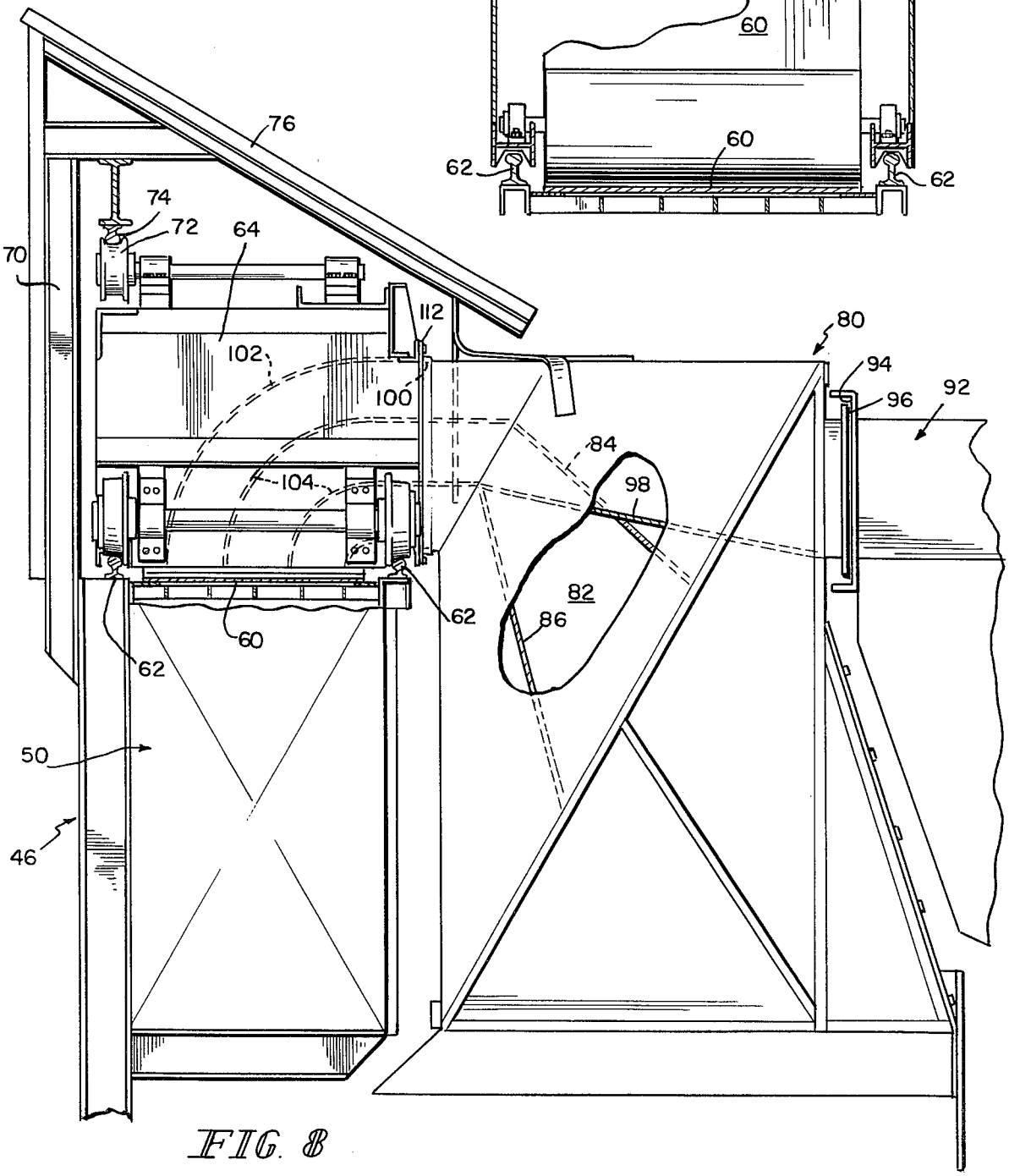
FIG. 8 is a partly fragmentary end elevational view of a detail of the installation, taken generally along section lines 8—8 of FIG. 3.
Figure 10:
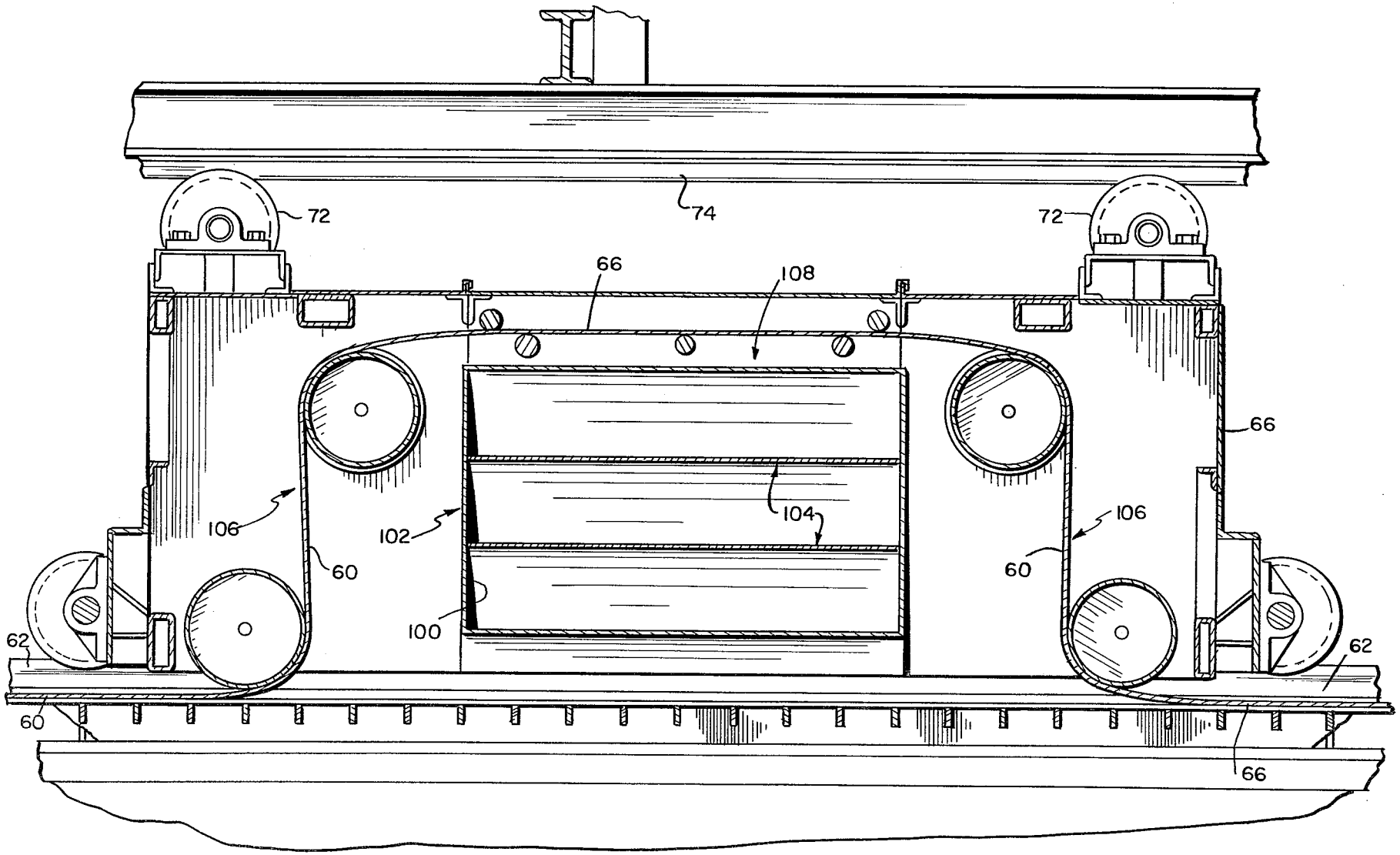
FIG. 10 is a sectional view of a detail taken generally along sectional lines 10—10 of FIG. 3.

Hood 80 is supported from the cars 64, 66. Hood 80 is evacuated into the duct 50 through openings 100 in cars 64, 66. As best illustrated in FIG. 8, each car 64, 66 includes an internal rectangular elbow duct section 102 with internal proportioning guides or vanes 104. The duct section 102 lies between the vertically extending runs 106 and beneath the horizontally extending run 108 of belt 60 within each car 64, 66 (see FIG. 10).

Figure 6:
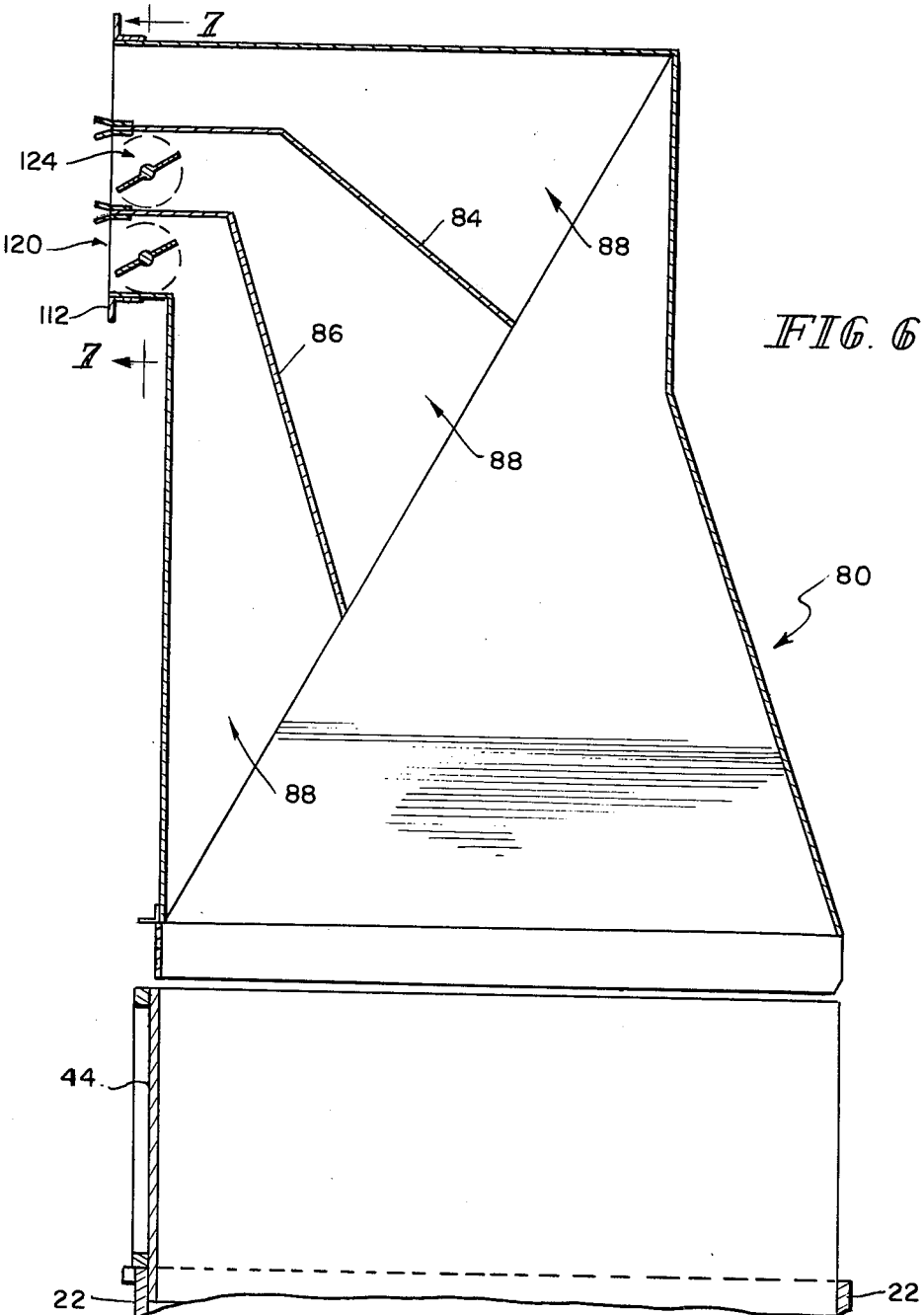
FIG. 6 is a fragmentary sectional view of a detail of the installation, taken generally along section lines 6—6 of FIG. 3.

The partitions 84, 86 angle upwardly, as illustrated in FIGS. 4 and 6. Near the cars 64, 66 partitions 84, 86 extend generally horizontally to mate with the exposed edges of the proportioning guides 104 in the internal elbow duct sections 102 of cars 64, 66. Flexible flaps 110 insure tight sealing engagement between the partition 84, 86 edges and the proportioning guides 104 in cars 64, 66. The hood 80 is illustratively attached to the cars 64, 66 by bolts through the car 64, 66 side walls and mating flanges 112 on the hood 80 (FIGS. 4, 6).

It is highly desirable under certain circumstances to be able to valve air flow from various sectors 88 as required during the various coke oven operations. To this end, butterfly valve dampers are provided for controlling flow from the various sectors 88 into cars 64, 66. Referring particularly to FIGS. 3–5, a damper 116 controlled by a handle 118 permits selective control of the flow into the lowermost sector 88 which is evacuated through the car 64. As best illustrated in FIG. 5, the upper and middle sectors 88 which empty into car 64 are not damper-controlled in this embodiment. However, it should be appreciated that dampers can be added as desired to control flow in these sectors.

Figure 7:
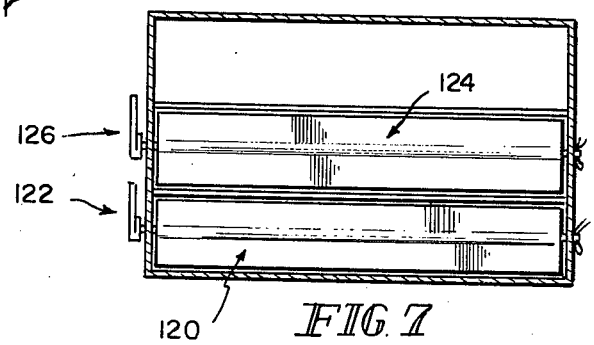
FIG. 7 is a fragmentary sectional view taken generally along section lines 7—7 of FIG. 6.
Figure 9:
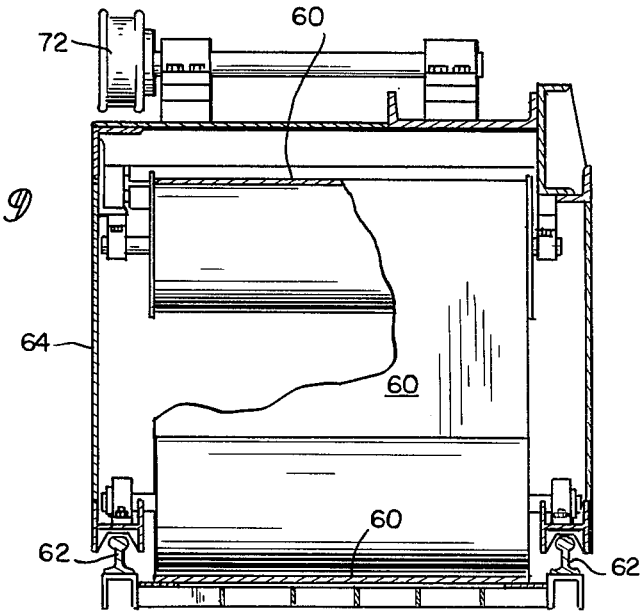
FIG. 9 is a sectional view of a detail taken along section lines 9—9 of FIG. 3.

With reference to FIGS. 3, 6 and 7, the lowermost sector 88 which is evacuated through car 66, is controlled by a damper 120 which is selectively actuable by a handle 122. The middle sector 88 which is evacuated through car 66 is controlled by a damper 124 which is selectively actuable by a handle 126. The upper sector 88 of the hood which is evacuated through car 66 is not damper controlled in the illustrated embodiment. However, it should be appreciated that a damper can be provided for such control.

Typically, the weight of the hood 80 is substantial. Prior art means for supporting such weight have included a separate framework adjacent the hood, with the framework supporting rails, and wheels on the hood movably engaging the rails. Such a system is the previously described Hartung, Kuhn-Carl Still system. A cantilever-support system illustrated herein, includes the wheels 72 rotatably mounted on cars 64, 66 and engaging the rail 74 mounted (70) from the duct 50 support pillars 46. This system supports the hood 80 by a simpler construction than systems of the above-described types.

The upward extensions 44 on the side walls of the quench car 22 permit the quench car locomotive 34 to pass freely beneath the hood 80 on its way to and from the quench tower 30.

Referring back to FIGS. 3–5, second valve means for selectively controlling evacuation of the second hood 90 through duct 98 includes a damper 128 controllable by a handle 130. As will be appreciated, the single damper 128 permits halving of the air flow through duct 98 from the hood 90. With the illustrated damper arrangement, flow from hood 90 cannot be completely stopped. However, it must be appreciated that an additional damper can be added to the duct 98 above internal partition 132 to halt the flow through the third duct 98 entirely, to suit the needs of a particular application.

The selectively actuable damper system illustrated permits a high degree of flexibility in the control of the extent of evacuation from beneath hoods 80, 90.

The illustrated multiple-car system helps to distribute the load represented by the weight of hood 80. Illustratively, a car, such as car 64, 66 may be provided for each 20 feet (approximately 6.1 meters) of length of hood 80.

What is claimed is:

1. A contaminant capture system for a coke oven pushing operation for a coke oven battery having a coke side provided with guide means movable along the battery for guiding coke from a selected oven of the battery during the push and a conveyor means movable along the battery to receive the coke pushed through the guide means and convey it to a quenching station, the system including suction means, a first duct extending along the battery and coupled to the suction means for evacuation thereby, the first duct including a wall portion closed by a flexible web, a car disposed for movement on the first duct to raise the web to couple the interior of the car to the interior of the first duct, mobile first hood means including means for coupling the first hood means to the interior of the car, means for moving the car to dispose the first hood means and overlying relation to a selected portion of the conveyor means to draw into the first hood means contaminants evolved as hot coke is transported on said conveyor means, mobile second hood means mounted on the guide means to draw into the second hood means contaminants evolved as hot coke is pushed from said selected oven to the conveyor means, a second duct for coupling the second hood means to the first hood means and thus to the first duct, a third duct provided internally of the first hood means and connected at one of its ends to the means for coupling the first hood means to the interior of the car, the third duct engaging the second duct when the first and second hood means are in a selected relative orientation to couple the second duct to the first duct.

2. The apparatus of claim 1 and further including first valve means for selectively controlling evacuation of the first hood means, the first valve means mounted in the means for coupling the first hood means to the interior of the car.

3. The apparatus of claim 2 and further comprising second valve means for selectively controlling evacuation of the second hood means, the second valve means mounted in the third duct between the third duct flange and the car.

4. The apparatus of claim 1 wherein the interior of the car includes proportioning guide means dividing the interior of the car into a plurality of duct portions.

5. The apparatus of claim 4 wherein the first hood means includes a third duct, the third duct engaging the second duct when the first and second hood means are in a selected relative orientation to couple the second duct to the first duct.

6. The apparatus of claim 5 wherein the means for coupling the first hood means to the interior of the car comprises a first one of said plurality of duct portions and the plurality of duct portions further includes a second duct portion coupled to the third duct.

7. The apparatus of claim 6 and further including first valve means for selectively controlling evacuation of the first hood means, the first valve means controlling flow in the first duct portion of the car interior.

8. A contaminant capture system including suction means, a first duct, means coupling the first duct to the suction means for evacuation thereby, the first duct including a wall portion closed by a flexible web, a car disposed for movement along the first duct to raise the web to couple the interior of the car to the interior of the first duct, mobile first hood means for capturing contaminants generated in a first area, the first hood means including means for partitioning the first hood means into a plurality of sectors, means for coupling the first hood means to the interior of the car and for moving the car to dispose the first hood means adjacent the first area to draw into the first hood means contaminants generated in the first area, mobile second hood means for capturing contaminants generated in a second area, a second duct for coupling the second hood means to the first hood means and thus to the first duct, the interior of the car including proportioning guide means dividing the interior of the car into a plurality of duct portions, the partition means of the first hood means extending into sealing engagement with the proportioning guide means such that gas flow from a selected sector of the first hood means enters the first duct via a particular duct portion of the car.

9. The apparatus of claim 8 wherein the plurality of duct portions includes a first duct portion, the apparatus further including valve means for selectively controlling the evacuation of the first hood means, the valve means mounted in the first hood means adjacent the first duct portion.

10. A contaminant capture system for a coke oven pushing operation for a coke oven battery having a coke side provided with guide means movable along the battery for guiding coke from a selected oven of the battery during the push and a conveyor means movable along the battery to receive the coke pushed through the guide means and convey it to a quenching station, the system including suction means, a duct extending along the battery and coupled to the suction means for evacuation thereby, the duct including a wall portion closed by a flexible web, a first car disposed for movement on the duct to raise the web to couple the interior of the first car to the interior of the duct, mobile hood means including means for dividing the first hood means into a plurality of sectors including a first sector, means for coupling the hood means to the interior of the first car, means for moving the first car to dispose the hood means in overlying relation to a selected portion of the conveyor means to draw into the hood means contaminants evolved as hot coke is transported on said conveyor means, and valve means for selectively controlling evacuation of the first sector of the hood means.

11. The apparatus of claim 10 comprising a second car disposed adjacent the first car for movement along the duct to raise the web to couple the interior of the car to the interior of the duct, means for coupling the hood means to the second car and for moving the second car contemporaneously with the first car to move the hood means in overlying relation to a selected portion of the conveyor means, the valve means controlling evacuation from said first sector through the means connecting the hood means to the second car.

12. A contaminant capture system including suction means, a duct, means coupling the duct to the suction means for evacuation thereby, the duct including a wall portion closed by a flexible web, a first car disposed for movement along the duct to raise the web to couple the interior of the first car to the interior of the duct, mobile hood means for evacuating contaminants from an area, means for coupling the hood means to the interior of the first car, means for moving the first car to dispose the hood means adjacent said area to draw into the hood means contaminants generated in said area, a second car disposed adjacent the first car for movement along the duct to raise the web and couple the interior of the second car to the interior of the duct, means for coupling the hood means to the second car, means for moving the second car contemporaneously with the first car as the hood means moves to capture contaminants in said area, the second car cooperating with the first to capture contaminants generated in said area, first valved means mounted in the means for coupling the mobile hood means to the first car for selectively controlling flow into the interior of the first car, and second valve means mounted in the means for coupling the mobile hood means to the second car for selectively controlling flow into the interior of the second car.

* * * * *